US010263318B2

(12) United States Patent
Yan

(10) Patent No.: US 10,263,318 B2
(45) Date of Patent: Apr. 16, 2019

(54) MOBILE TERMINAL

(71) Applicant: Wei Yan, Shenzhen (CN)

(72) Inventor: Wei Yan, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 69 days.

(21) Appl. No.: 15/061,646

(22) Filed: Mar. 4, 2016

(65) Prior Publication Data

US 2017/0033436 A1 Feb. 2, 2017

(30) Foreign Application Priority Data

Jul. 31, 2015 (CN) ..... 2015 1 0460533

(51) Int. Cl.
*H01Q 1/24* (2006.01)

(52) U.S. Cl.
CPC ..... *H01Q 1/243* (2013.01)

(58) Field of Classification Search
CPC ..... H01Q 1/24; H01Q 1/48; H01Q 1/241–1/243; H01Q 5/378; H01Q 5/385; H01Q 5/392
USPC ..... 343/702, 848, 904, 833, 834
See application file for complete search history.

(56) References Cited

U.S. PATENT DOCUMENTS 9,153,870 B2 * 10/2015 An ..... H01Q 1/243
2012/0256800 A1 * 10/2012 Kuonanoja ..... H01Q 1/243 343/749
2013/0257659 A1 * 10/2013 Darnell ..... H01Q 1/243 343/702
2014/0327584 A1 * 11/2014 Chang ..... H01Q 5/378 343/702
2015/0147984 A1 * 5/2015 Ying ..... H04B 1/3827 455/90.3
2015/0380812 A1 * 12/2015 Black ..... H01Q 1/243 343/861
2016/0134010 A1 * 5/2016 Yan ..... H01Q 1/1207 343/702
2016/0134321 A1 * 5/2016 Yan ..... H04B 1/3888 455/575.1

(Continued)

FOREIGN PATENT DOCUMENTS

CN 204216224 * 10/2014

OTHER PUBLICATIONS

The ARRL Antenna Book by The American Radio Relay League (Gerald Hall, 1988).*

*Primary Examiner* — Jessica Han
*Assistant Examiner* — Awat M Salih
(74) *Attorney, Agent, or Firm* — Na Xu; IPro, PLLC

(57) ABSTRACT

A mobile terminal is disclosed. The mobile terminal includes a metal housing with an accommodation space, the metal shell including a metal housing having a metal cover, a metal ring disposed outside of the metal cover, and a metal rear housing; an antenna module received in the accommodation space. The antenna module includes a main board with a grounding terminal, the main board including a switching circuit connected with the grounding end of the main board electrically and an LDS antenna controlled by the switching circuit. The main board is connected with the metal cover and the metal ring electrically, the metal cover and the metal ring is coupled with the LDS antenna.

6 Claims, 5 Drawing Sheets

(56) References Cited

U.S. PATENT DOCUMENTS

2016/0301138 A1* 10/2016 Hwang ..... H01Q 9/42
2016/0323003 A1* 11/2016 Shi ..... H04M 1/03

* cited by examiner

MOBILE TERMINAL

FIELD OF THE INVENTION

The present invention relates to mobile communication technology field.

DESCRIPTION OF RELATED ART

With the development of mobile communication technology, cell phone, PAD, laptop etc. gradually become the indispensable electronic products in life, and the antenna system is added for this kind of electronic product to make it become electronic communication product with communication function. But consumer is not only satisfied with the application function of the antenna system and but also puts forward requirements on the appearance. In order to pursue fashionable appearance molding, existing mobile terminal, especially the cell phone in mobile terminal, the cell phone molding of traditional plastic housing has not been satisfied by the demands of one part of medium-end and high-end personages. They have higher demands on the appearance of cell phone, so the cell phone with metal housing becomes one kind of trend. Relative to the housing of other materials, it is not only fashionable and beautiful but also has the advantages of good rigidity, large strength, thin size, recycling and good heat dispersion, but metal housing has the vital electromagnetic shielding to the antenna inside the metal housing.

In order to solve this problem, in some cell phone designs, such as on iPhone cell phone, the metal frame antenna fed directly to metal housing directly is adopted. Although this design solves the problem of radiation of antenna under metal environment, the shortcomings of bad performance of narrow high frequency band and wide low frequency band still exists, which is hard to satisfy with the communication demands of mobile terminal.

Therefore, it is necessary to provide a new mobile terminal to overcome the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
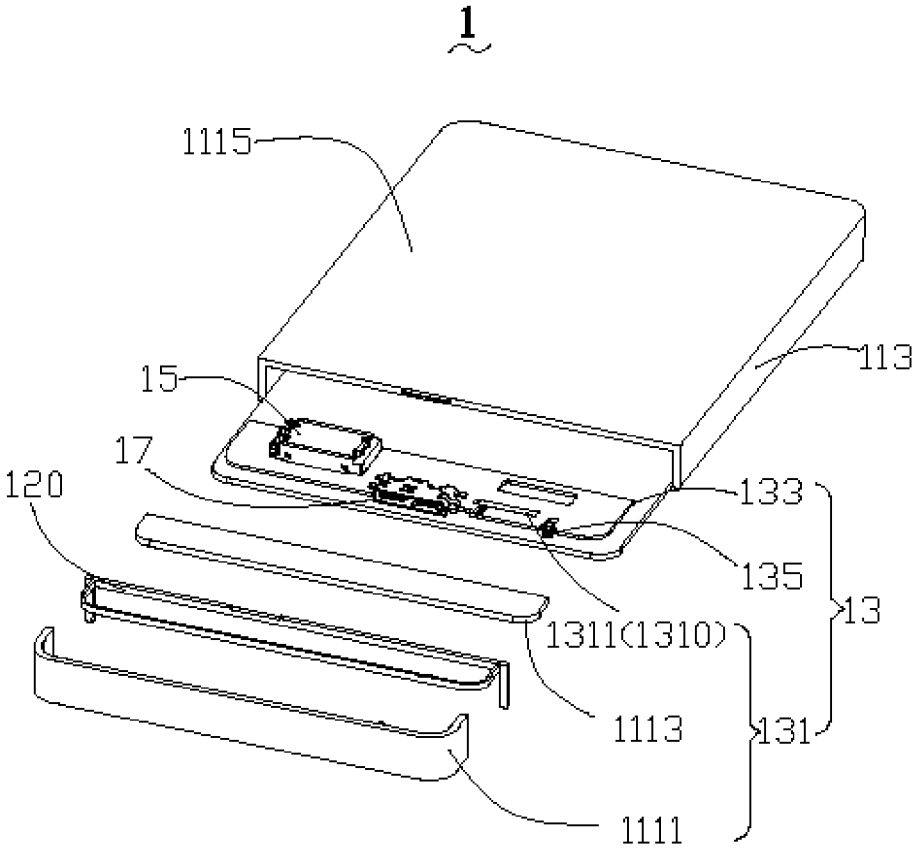
FIG. 1 is an isometric and exploded view of a mobile terminal in accordance with an exemplary embodiment of the present disclosure.
Figure 2:
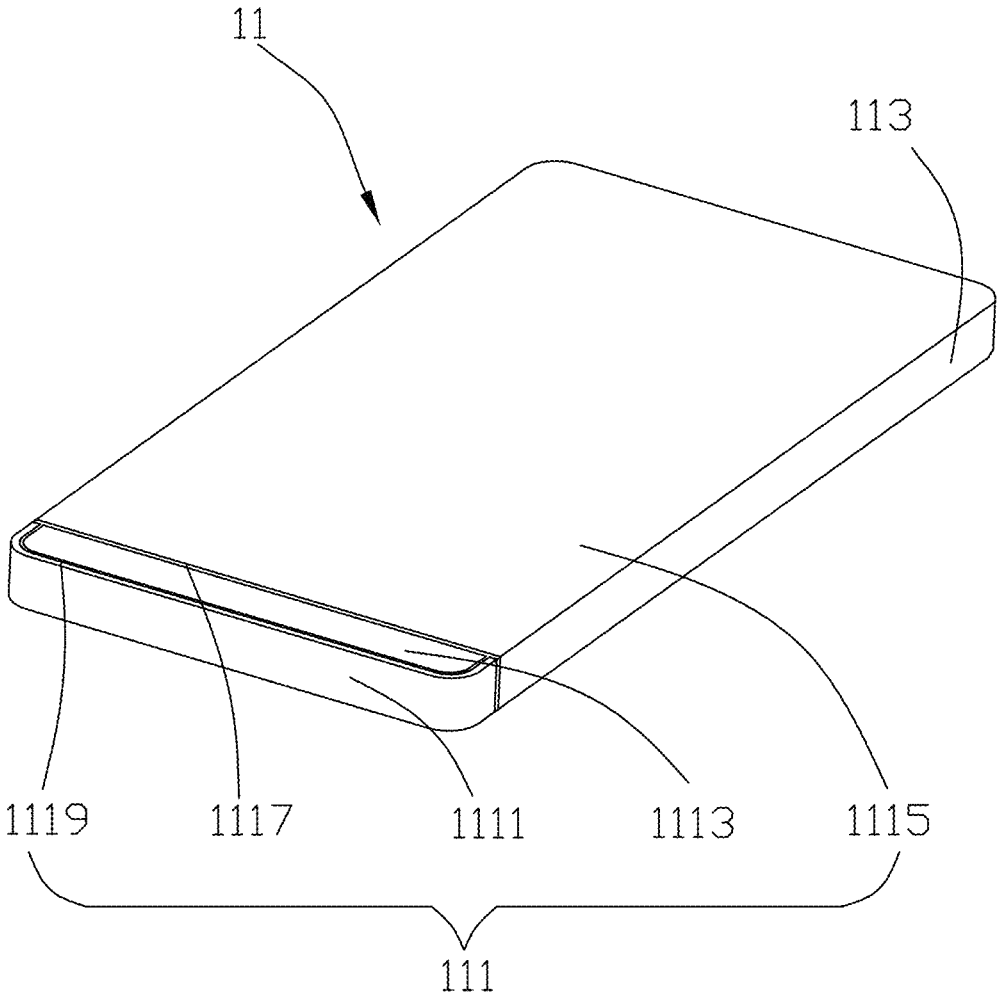
FIG. 2 is an isometric view of a metal housing of the mobile terminal in FIG. 1.

Referring to FIGS. 1-2, a mobile terminal in accordance with an exemplary embodiment of the present disclosure includes a metal shell. The mobile terminal 1 includes a metal housing 11 with an accommodation space, an antenna module 13, a loudspeaker 15 and a USB module 17. The antenna module 13, the loudspeaker 15 and the USB module 17 are received in the accommodation space.

The metal shell 11 includes a metal housing 111 and a metal frame 113. The metal housing 111 cooperates with the metal frame 113 for forming the accommodation space.

The metal housing 111 includes a metal ring 1111, a metal cover 1113, a metal rear cover 1115, a first gap 1117 and a second gap 1119. The metal ring 1111 is set on the outside of the metal cover 1113. The metal cover 1113 is set close to the antenna module 13. The metal ring 1111 and the metal cover 1113 are taken as the radiators of the antenna module 13 in the invention. The metal ring 1111 and the metal cover 1113 are set alternately through the second gap 1119. The metal cover 1113 and the metal rear housing 1115 are set alternately through the first gap 1117. The first gap 1117 and the second gap 1119 are filled by using non-conductive materials. The filler material can be plastics or glass. The first gap 1117 and the second gap 1119 filled by the non-conductive materials can make antenna radiate energy. The first gap 1117 and the second gap 1119 are filled by the filler material, a joint structure 120 is accordingly formed, namely the metal ring 1111, the metal cover 1113, the metal rear housing 1115 and the metal frame 113 form the complete metal housing structure through the joint structure 120. Specifically, a width of the metal cover 1113 is 7~9 mm (millimeter, same as below). a width of the first gap 1117 is 0.8~1.2 mm. A width of the second gap 1119 is 0.4~0.6 mm. A width of the metal cover 1113 is defined to be the length of the shorter edge of the metal cover 1113 in a horizontal plane. The metal rear housing 1115 in the embodiment serves as the main board of the antenna module.

The metal frame 113 is disposed outside of the metal rear housing 1115 and integrates with the metal rear housing 1115 for forming the molding structure.

The antenna module 13 includes an antenna main body 131, a main board 133 and a point-contact spring 135.

The antenna main body 131 includes an LDS antenna 1310 and a support 1311. It is well known that the setting of the parameters of the length and height of the antenna module influences the performance of the antenna module. In the disclosure, couple and connect the metal ring 1111 and or the metal cover 1113 and the LDS antenna 1310 to form antenna used to adjust the receiving or sending of wave radio. The LDS antenna 1310 is set on the plastics. The LDS antenna can adjust resonance frequency through the adjustment of the LDS pattern size. The way of adjusting is simple and reliability is strong. Specifically, the LDS antenna can be set on the external surface of the housing of the loudspeaker and the support 1311 as well. Setting the LDS antenna on the surface of the housing of the loudspeaker can omit the using of extra support and reducing of the quantity of element in favor of realizing the overall thin of the mobile terminal. When the LDS antenna 1310 is set on the support 1311, as shown in FIG. 1, the support 1311 is fixed and set on the main board 133 and located on the same side of the main board 133 with the loudspeaker 15. As an independent element, the support 1311 is fixed and processed conveniently.

The main board 133 and the metal cover 1113 are set opposite to each other, including grounding term (not shown on the figure) and switching circuit (not shown on the figure). The antenna module 13 can be grounded through the metal housing 11 through the grounding terminal. The switching circuit is used for controlling the grounding treatment of LDS antenna. The LDS antenna is controlled as parasitic antenna or connected not as antenna through controlling the switching circuit or connecting or disconnecting the grounding terminal (only the metal ring 1111 and the metal cover 1113 are taken as antenna radiator) to make the antenna module 13 to cover wider high frequency bandwidth and wider low frequency bandwidth. The concreteness is as follows: when circuit is on the opening status, as parasitic antenna, the LDS couples with the metal radiator. The generated high frequency resonance is 1710 MHz-2170 MHz and the generated low frequency resonance is 824 MHz-894 MHz. When circuit is on closing status, the antenna frequency band that antenna module 13 meet are low frequency 880 MHz-960 MHz and high frequency 2300 MHz-2690 MHz. The antenna module 13 can work under the following frequency bands through the controlling of the switching circuit. Low frequency 824 MHz-960 MHz and high frequency 1710 MHz-2690 MHz. While the high frequency bandwidth is widened, the performance of low frequency bandwidth is improved. The plan solves the wide frequency band design requirements of LTE antenna under the full metal machine body environment.

At the same time, the main board 133 also can includes a matching circuit (not shown) and an antenna switch (not shown). The LDS antenna can be connected with different matching circuits through the antenna switch to make it have different load characteristics. Different resonance frequencies can be realized to expand its bandwidth.

The point-contact spring 135 is welded on the main board 133. The quantity can be more used to realize the electrical connection of the metal ring 1111, the metal cover 1113 with the main board 133.

The loudspeaker 15 is connected with the main board 133 electrically. When the LDS antenna is embedded and set on the surface of the housing of the loudspeaker 15. The loudspeaker 15 needs to be fixed on the main board 133 to control the distance of the LDS with the metal housing 11 consistent to avoid the deficiency of bad consistency and antenna frequency deviation. Specially, the loudspeaker 15 is connected with the main board 133.

The USB module 17 is connected with the main board 133 electrically and set on the same side of the main board 133 with the loudspeaker 15. The USB module 17 can provide interface used for transmitting data and charging the cell phone.

Figure 3:
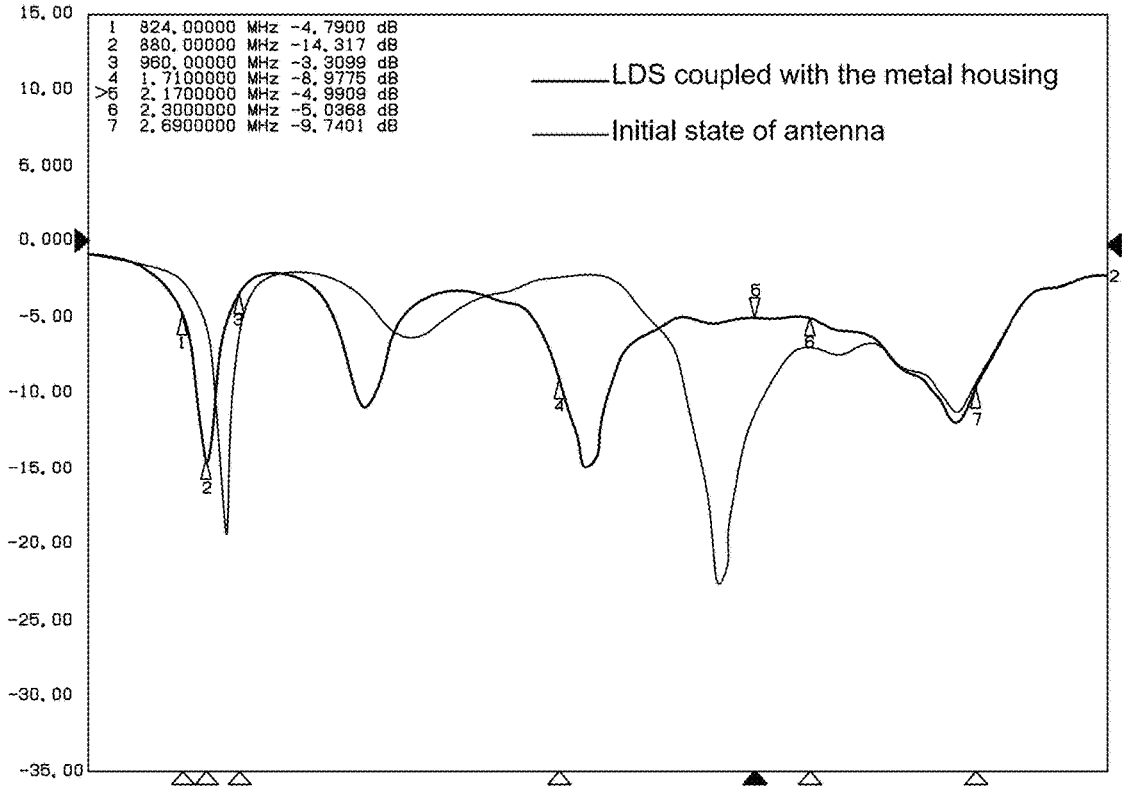
FIG. 3 is a diagram showing the return loss of an antenna module of the mobile terminal of the embodiment.

Referring FIG. 3, the diagram shows the return loss of seven frequency points generated by the coupling of LDS antenna and metal housing. They are 1:824 MHz, −4.7900 dB; point 2:880 MHz, −14.317 dB; point 3:960 MHz, −3.3099 dB; point 4:1.71 GHz, −8.9775 dB; point 5:2.17 GHz, −4.9909 dB; point 6:2.30 GHz, −5.0368 dB; point 7: 2.69 GHz, −9.7401 dB respectively. At the same time, the recovery loss situation of original status of the antenna (only part of metal housings are taken as the metal radiator) is given. Thus it can be seen that the antenna module provided by the invention has the advantages of wide high frequency bandwidth (the width of high frequency bandwidth can reach 1710 MHz-2690 MHz) and good performance of low frequency band (the low frequency bandwidth can reach 824 MHz-960 MHz).

Figure 4:
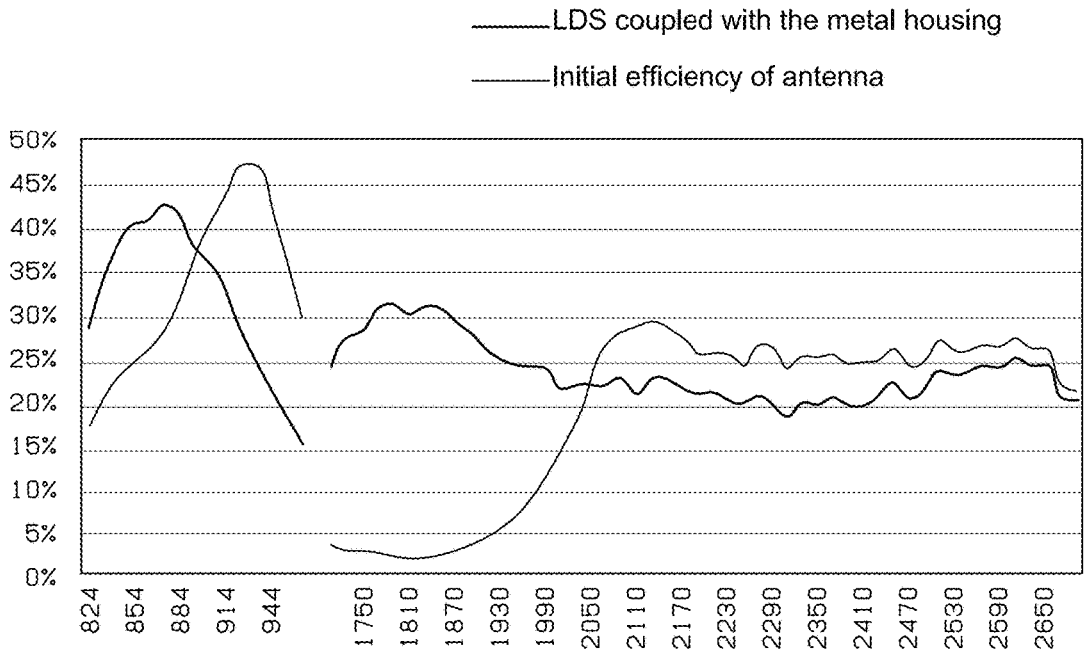
FIG. 4 is a diagram (A) showing the antenna efficiency of the antenna module of the mobile terminal of the embodiment.
Figure 5:
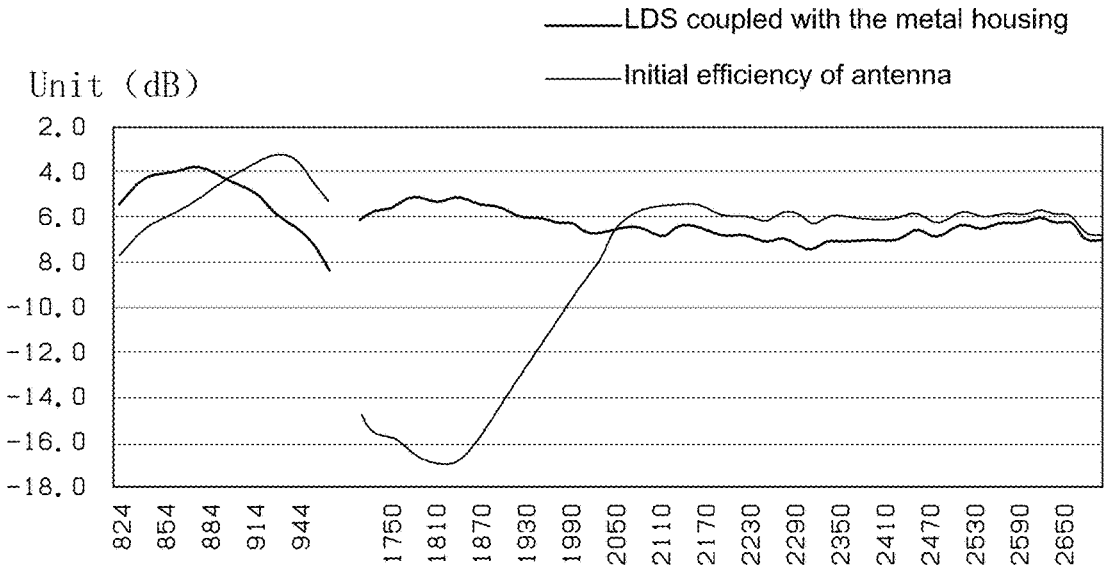
FIG. 5 is a diagram (B) showing the antenna efficiency of the antenna module of the mobile terminal of the embodiment.

Referring to FIGS. 4-5, the plan provided by the invention can work under high frequency and low frequency bands by combining the data of the antenna efficiency of antenna module in table 2 under the high frequency and low frequency band. The radiation efficiency is improved obviously.

TABLE 1

The antenna efficiency of antenna module under high frequency and low frequency band

| Efficiency (%) | LB (824~894 MHz) | LB (880~960 MHz) | HB (1710~2170 MHz) | HB (2300~2690 MHz) |
|---|---|---|---|---|
| Min | 28 | 29 | 21 | 21 |
| Max | 43 | 47 | 31 | 27 |
| Avg | 38 | 39 | 25 | 25 |

TABLE 2

The antenna efficiency of antenna module under high frequency and low frequency band

| Efficiency (dB) | LB (824~894 MHz) | LB (880~960 MHz) | HB (1710~2170 MHz) | HB (2300~2690 MHz) |
|---|---|---|---|---|
| Min | −5.5 | −5.3 | −6.8 | −6.8 |
| Max | −3.7 | −3.3 | −5.1 | −5.7 |

The mobile terminal 1 provided by the invention has the following advantageous effects:

I. The invention takes one part of the metal shell 11 of the full metal cell phone to couple with LDS. Before being coupled (LDS antenna is not connected as antenna). The metal housing 11 works as the radiation metal body. The working antenna frequency band of the antenna module 13 are low-frequency 880-960 MHz and high-frequency 2300-2690 MHz.After being coupled(LDS antenna works as parasitic antenna). The working antenna frequency band is low frequency 824-894 MHz and high frequency 1710-2170 MHz.Through the setting and controlling of switching circuit of LDS antenna grounding, namely control the LDS antenna as the parasitic antenna or not connected as the antenna. The antenna module 13 can work under low frequency band 824~960 MHz and high frequency band 1710~2690 MHz. It has the advantages of wide high frequency band and good performance of low frequency bandwidth to make the mobile terminal of the invention to meet higher communication demands.

II. LDS antenna can work as one part of antenna. The resonance frequency can be adjusted through the adjustment of LDS pattern size. The way of adjusting is simple and reliability is strong.

III. LDS antenna can be set on the external surface of the housing of the loudspeaker 15 directly. Setting LDS antenna on the external surface of the loudspeaker 15 omit the using of extra support and reducing of quantity of element in favor of realizing the overall thin of the mobile terminal.

IV. LDS antenna is set on support 1311. The support 1311 is easy to fix and process at the same time as an independent element.

V. Controlling the connection status of LDS antenna through switching circuit can realize the design demands of wide band width required by high frequency and improve low frequency band width to certain degree too. The program can solve the design demands of high frequency and low frequency bandwidth of LTET antenna under the full metal machine body environment very well.

VI. As the metal radiators, the metal ring 1111 and metal cover 1113 are set alternately through the second gap 1119. The metal cover 1113 and the metal rear housing 1115 are set alternately through the first gap 1117. The first gap 1117 and the second gap 1119 are filled by using non-conductive material.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mobile terminal, comprising:

a metal housing with an accommodation space, the metal housing having a metal cover, a metal ring disposed outside of the metal cover, and a metal rear housing;

an antenna module received in the accommodation space, the antenna module including:

a main board with a grounding terminal, the main board including a switching circuit connected with the grounding end of the main board electrically and an LDS antenna controlled by the switching circuit; wherein the main board is connected with the metal cover and the metal ring electrically, the switching circuit controls the connecting between the LDS antenna and the grounding terminal;

when the LDS antenna is disconnected with the grounding terminal, the mobile terminal has an operating frequency which includes low frequency band within 880~960 MHz and high frequency band within 2300~2690 MHz;

when the LDS antenna is connected with the grounding terminal, the metal cover and the metal ring are coupled with the LDS antenna, the mobile terminal has an operating frequency which includes low frequency band with 824~894 MHz and high frequency band within 1710~2170 MHz.

2. The mobile terminal as described in claim 1 further including a loudspeaker fixed and set on the main board for being connected with the main board electrically, wherein the LDS antenna is set on an external surface of the loudspeaker.

3. The mobile terminal as described in claim 1, wherein the metal housing further includes a first gap and a second gap, the metal cover and the metal rear housing are set through the first gap alternately, the metal ring and the metal cover are set alternately through the second gap, the first gap and the second gap are filled by using non-conductive material, and the metal ring and the metal rear housing are set through the first gap alternately, the first gap and the second gap forming a ring which surrounds the metal cover.

4. The mobile terminal as described in claim 3, wherein a width of the first gap is 0.8~1.2 mm.

5. The mobile terminal as described in claim 4, wherein a width of the second gap is 0.4~0.6 mm.

6. The mobile terminal as described in claim 1, wherein the metal cover and the metal ring serve as the radiators of the antenna module.

* * * * *